US007445490B2

(12) United States Patent
Jacobson

(10) Patent No.: US 7,445,490 B2
(45) Date of Patent: Nov. 4, 2008

(54) INTEGRATED OVERMOLDED CABLE SEAL AND GASKET FOR AN ELECTRONIC MODULE

(75) Inventor: Jon Thomas Jacobson, Fargo, ND (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 11/689,532

(22) Filed: Mar. 22, 2007

(65) Prior Publication Data

US 2008/0233783 A1 Sep. 25, 2008

(51) Int. Cl.
*H01R 13/58* (2006.01)

(52) U.S. Cl. ..... 439/465; 439/447

(58) Field of Classification Search ..... 439/465, 439/447

See application file for complete search history.

(56) References Cited

U.S. PATENT DOCUMENTS

| | | | | |
|---|---|---|---|---|
| 4,505,151 | A | 3/1985 | Sauerschell et al. | |
| 5,295,859 | A * | 3/1994 | Kawai et al. | 439/455 |
| 6,595,791 | B2 * | 7/2003 | Below et al. | 439/271 |
| 2002/0096341 | A1 | 7/2002 | Hagan et al. | |
| 2005/0022358 | A1 | 2/2005 | Hagan et al. | |
| 2005/0061524 | A1 | 3/2005 | Hagan et al. | |

* cited by examiner

*Primary Examiner*—Tho D. Ta
*Assistant Examiner*—Vanessa Girardi

(57) ABSTRACT

An electronic module includes a housing with at least two housing parts; a cable including a sheath end and a plurality of conductors extending from the sheath end; and a one-piece, multi-function seal between the cable and the housing. The multi-function seal includes a cable seal overmolded on the cable at the sheath end with the plurality of conductors being exposed from the multi-function seal. The multi-function seal further includes an integral gasket extending from the cable seal and positioned between at least two housing parts.

27 Claims, 3 Drawing Sheets

INTEGRATED OVERMOLDED CABLE SEAL AND GASKET FOR AN ELECTRONIC MODULE

FIELD OF THE INVENTION

The present invention relates to electronic assemblies for use in work machines, and, more particularly, to electronic modules containing electronic circuit boards for use in such work machines.

BACKGROUND OF THE INVENTION

Work machines such as agricultural tractors, combines, construction and forestry equipment continually rely to a greater extent upon electronics and electronic controls. Work machines may operate in extreme environments compared to other applications. Among other concerns, it is necessary for on-board electronics to be designed from an electronics packaging standpoint with vibration, heat transfer and electromagnetic interference (EMI) in mind. Thus, electronics for work machines must be generally of a robust design.

When designing electronic modules that are to be embedded in an application such as a tractor or construction vehicle, it is critical that the mechanical packaging concept (the enclosure holding the electronic circuit boards) is sealed against possible exposure to the elements and designed to withstand high levels of vibration. For example, an electronic module mounted on the arm of a backhoe or trencher may be completely submersed in water for periods of time as the operator digs into swampy ground. Failure points for electronics modules in these situations include the seam between enclosure halves and any opening in the enclosure, such as the location where a cable exits the enclosure to connect to an external module. These potential trouble spots must be thoroughly sealed against the intrusion of moisture and dust. In addition, when a cable enters the module, it must be connected at some point to the printed circuit board inside the enclosure. This point of connection can be a potential failure point if the module is subjected to high levels of vibration and mechanical shock.

There are industry standard methods for addressing these potential failure points. To seal two halves of an enclosure against the environment, designers may use a pre-formed gasket (of silicone or similar material) sandwiched between the halves to prevent intrusion. Other methods include dispensing a bead of wet sealing material around the lip of one or both of the enclosure halves and pressing them together to form a seal. Although these same gasketing methods can be used around the opening where a cable exits the enclosure, it is more difficult to create a seal between the dislike materials of the enclosure and the cable. A technique called overmolding, in which a plastic or similar material is molded around wires to create a kind of protective shell can be used to create a cable that has a built in seal molded around it. This is a separate and additional process that must be used in addition to the gasket placed between the enclosure halves.

To address the issue of connecting a cable to a printed circuit board, it is often best to insert the incoming wires directly into preformed holes in the circuit board, and solder each independently, rather than try to use a connector that may vibrate the board during use. Unfortunately, this practice often requires hand placement of the individual wires in the holes, which is subject to error, and hand soldering. These manual practices are labor intensive and increase the cost of the module.

What is needed in the art is an electronic module which is easier and faster to assemble, and has less chance for assembly errors.

SUMMARY OF THE INVENTION

The invention in one form is directed to an electronic module, including a housing with at least two housing parts; a cable including a sheath end and a plurality of conductors extending from the sheath end; and a one-piece, multi-function seal between the cable and the housing. The multi-function seal includes a cable seal overmolded on the cable at the sheath end with the plurality of conductors being exposed from the multi-function seal. The multi-function seal further includes an integral gasket extending from the cable seal and positioned between at least two housing parts.

The invention in another form is directed to method of manufacturing an electronic module, including the steps of: overmolding a one-piece, multi-function seal over an end of an electrical cable having a plurality of conductors, the multi-function seal including a cable seal overmolded on the cable end with the plurality of conductors being exposed from the multi-function seal, the multi-function seal further including an integral gasket extending from the cable seal; positioning the multi-function seal on a first housing part such that the gasket overlies an edge of the first housing part; and positioning a second housing part on the gasket such that the gasket overlies an edge of the second housing part.

DETAILED DESCRIPTION OF THE INVENTION

Figure 1:
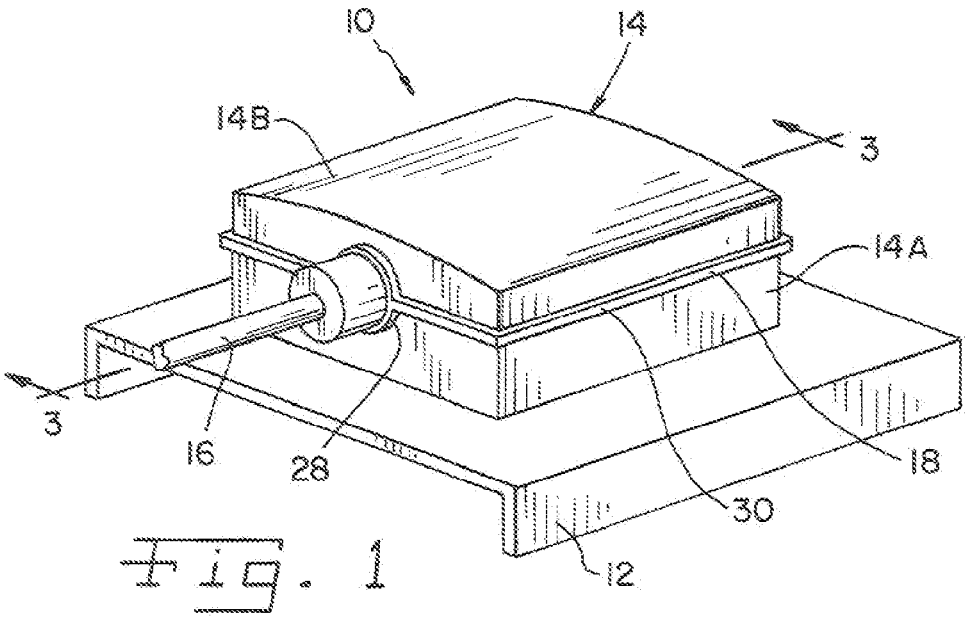
FIG. 1 is a perspective view of an embodiment of an electronic module of the present invention, mounted to a structural member of a work machine.
Figure 2:
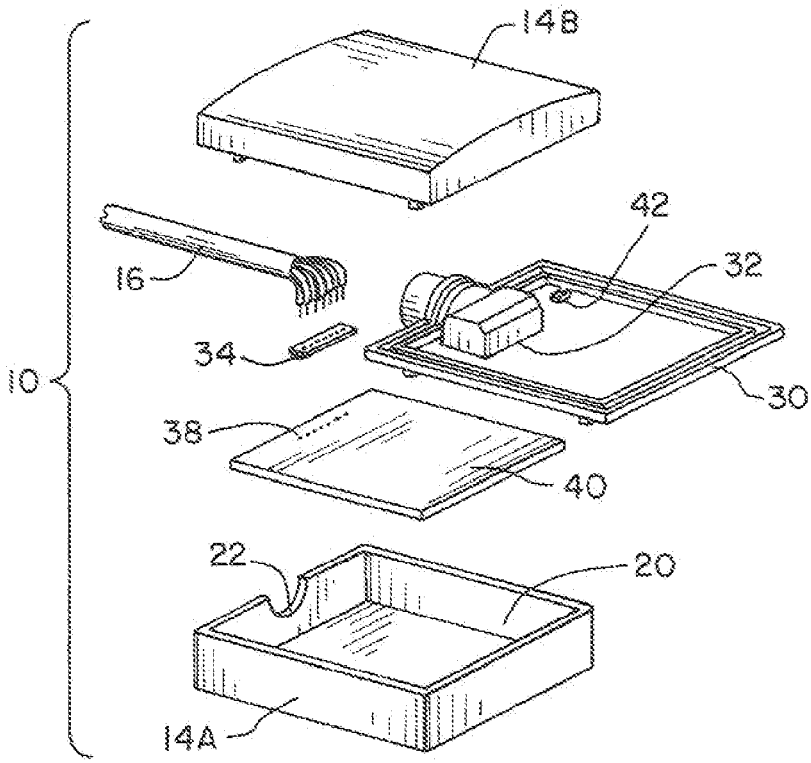
FIG. 2 is an exploded view of the electronic module shown in FIG. 1.
Figure 3:
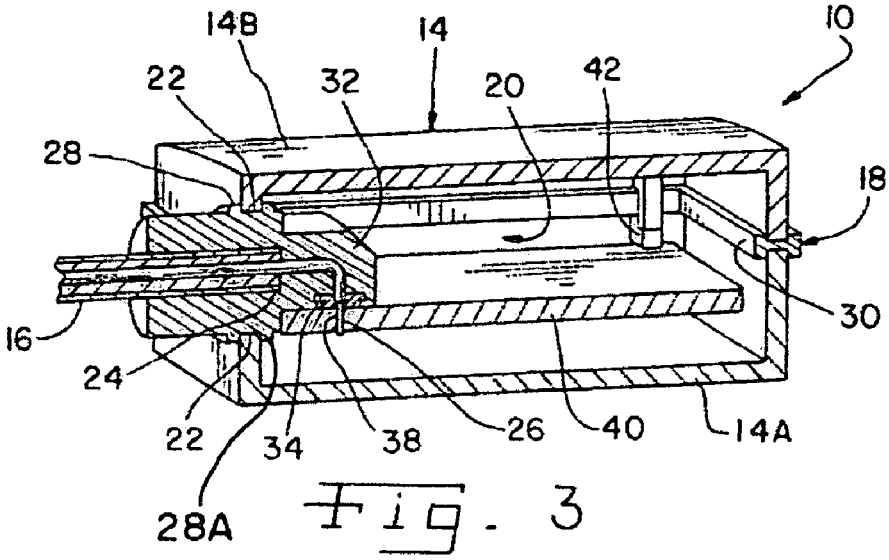
FIG. 3 is a side, sectional view of the electronic module taken along line 3-3 in FIG. 1.

Referring now to the drawings, and more particularly to FIGS. 1-3, there is shown an embodiment of an electronic module 10 which may be mounted to a structural member 12 of a work vehicle, such as an agricultural or industrial tractor, forestry equipment, etc. In the embodiment shown, electronic module 10 is in the form of a power distribution module which is mounted to structural member 12, but could be in the form of a different type of electronic module mounted to structural member 12. Structural member 12 can be any suitable structure for supporting electronic module 10, such as a vehicle frame, chassis, body, bulkhead, boom arm, etc.

Electronic module 10 generally includes a housing 14, a cable 16 and a one-piece, multi-function seal 18. Housing 14 is a multiple piece housing including at least two housing parts 14A and 14B defining a housing interior 20. Housing 14 may include more than two housing parts, depending upon the application. Housing parts 14A and 14B each include a mating cut-out 22 which are complimentary with each other to form an opening for receiving cable 16.

Figure 4:
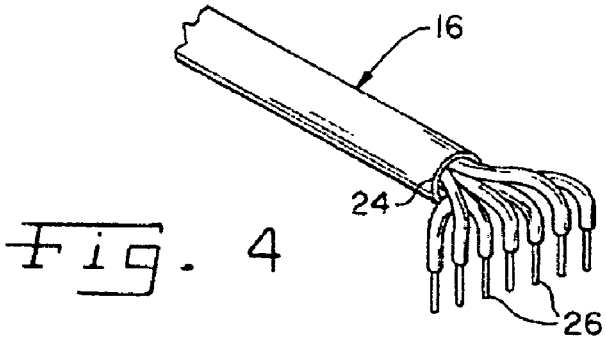
FIG. 4 is a perspective view of the cable shown in FIGS. 1-3.

Cable 16 includes a sheath end 24 and a plurality of conductors 26 extending from sheath end 24(FIGS. 2-4). Conductors 26 are typically formed with an extruded, insulative covering, usually color coded for each conductor. Conductors 26 may be configured for carrying electrical power and/or data, depending upon the application.

Multi-function seal 18 is positioned between cable 16 and housing 14. Multi-function seal 18 generally includes a cable seal 28, gasket 30 and alignment head 32 (FIGS. 1-3, 5 and 7). Cable seal 28 is overmolded on cable 16 at sheath end 24 and the plurality of conductors 26 are exposed from multi-function seal 18 as shown in FIG. 3 (i.e., conductors 26 extend through cable seal 28 and are exposed outside multi-function seal 18). Cable seal 28 includes an annular groove at the periphery thereof which seals with cut-outs 22 of housing 14. Gasket 30 is monolithically integral with and extends from cable seal 28. Gasket 30 is positioned and hermetically seals between at least two housing parts, such as housing parts 14A and 14B as shown in FIGS. 1 and 3.

Cable seal 28 also preferably includes an integral strain relief 28A, defined by an extended portion extending away from housing 14. Strain relief 28A is also intimately bonded with sheath end 24 through overmolding.

Figure 5:
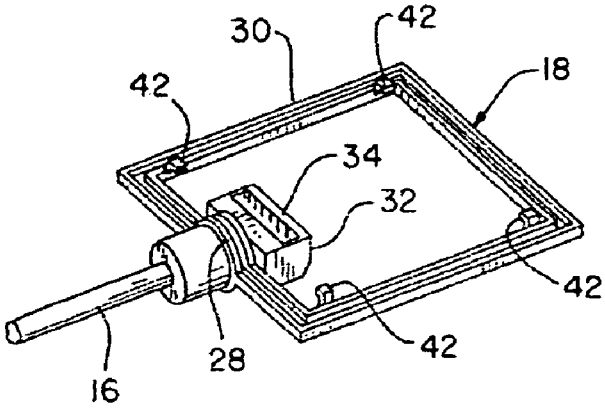
FIG. 5 is a perspective view of the multi-function seal shown in FIGS. 1-3, overmolded on the cable of FIGS. 1-4.
Figure 6:
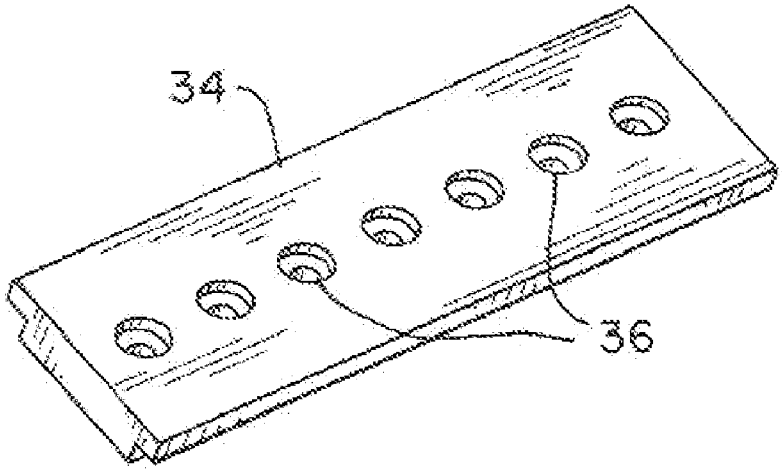
FIG. 6 is a perspective view of the wire presenter shown in FIGS. 2, 3 and 5.

Alignment head 32 is monolithically integral with cable seal 28 at an interior of housing 14 (FIGS. 2, 3, 5 and 7). Alignment head 32 is configured for aligning the plurality of conductors 26 in a predetermined orientation relative to each other. In the embodiment shown, alignment head 32 is configured for aligning the plurality of conductors 26 in a linear array of equidistantly spaced conductors extending from alignment head 32. To assist in proper orientation of conductors 26, a wire presenter 34 is overmolded (e.g., insert molded) within alignment head 32 (FIGS. 3, 5 and 6). Wire presenter 34 includes a plurality of holes 36, with each conductor 26 being positioned within a corresponding hole 36. To further assist in proper orientation of conductors 26, it is possible to form wire presenter 34 with color coded holes or labels which correspond to the color coded insulative coverings on conductors 26.

Holes 36 in wire presenter 34 are positioned to align with respective solder holes 38 formed in a circuit board 40 carried within housing 14 (FIGS. 2 and 3). The ends of conductors 26 are soldered within corresponding solder holes 38 using suitable soldering techniques. Solder holes 38 are in turn coupled with traces and electrical components carried on circuit board 40, which can vary depending upon the application.

Gasket 30 has an overall shape which corresponds to the peripheral adjoining edges of housing parts 14A and 14B, e.g., a generally rectangular shape in the embodiment shown. Gasket 30 has a generally H-shaped cross section allowing receipt of and sealing with each peripheral adjoining edge of housing parts 14A and 14B. Gasket 30 also optionally includes a plurality of locating features 42 extending from gasket 30 for locating circuit board 40 within housing 14. In the embodiment shown, locating features 42 have a generally L-shaped cross section with the foot of each L used for locating and pressing against circuit board 40. Suitable seats may be formed in the interior sidewall of housing part 14A, or standoffs or the like may be used on the opposite side of circuit board 40, to maintain a proper standoff distance from housing 14. Alternatively, locating features 42 can be formed with a groove or the like for holding an edge of circuit board 40. Of course, the size and shape of gasket 30, locating features 42 and/or the peripheral adjoining edges of housing parts 14A and 14B can vary, depending upon the application.

Figure 7:
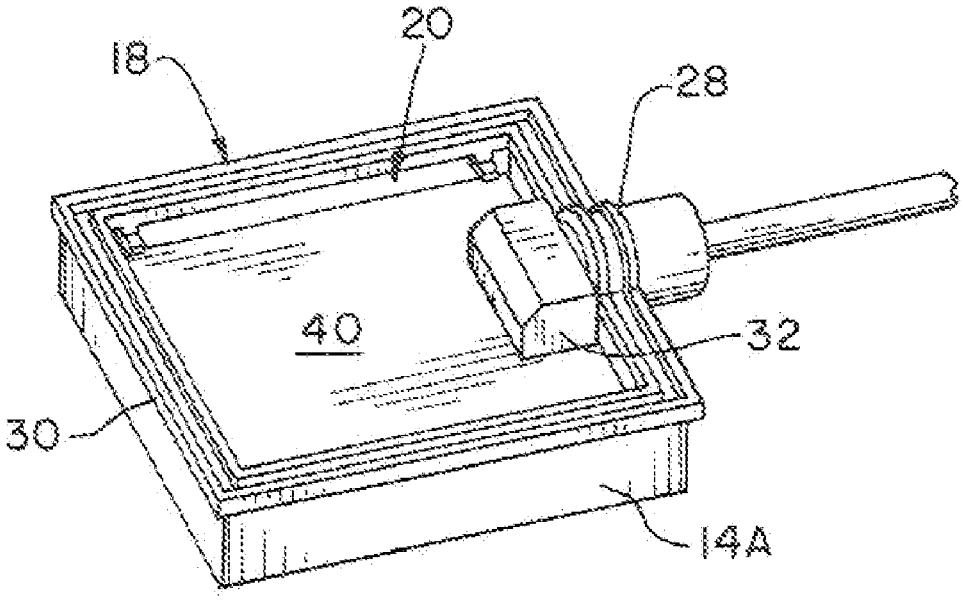
FIG. 7 is a perspective view of the electronic module shown in FIG. 1, with the top housing part removed.

During manufacture and assembly, the ends of conductors 26 are placed within respective holes 36 formed in wire presenter 34. Wire presenter 34 is then inserted into a mold cavity. The mold is closed and a suitable plastic or other material is injected into the mold cavity to form the one-piece, multi-function seal 18. The cable 16 with overmolded multi-function seal 18 (FIG. 5) is removed from the mold cavity. The ends of conductors 26 extending from alignment head 32 are placed in respective solder holes 38 and soldered in place on circuit board 40. Circuit board 40 is placed within housing part 14A and multi-function seal 18 is arranged such that cable seal 28 is positioned within cut-outs 22 and gasket 30 overlies and seals with the peripheral edge of housing part 14A (FIG. 7). Housing part 14B is then positioned on housing part 14A such that gasket 30 overlies and seals with the peripheral edge of housing part 14B (FIGS. 1 and 3). Housing parts 14A and 14B may be fastened together using suitable fasteners, snap fittings, etc. It will be appreciated that the particular sequencing of the manufacturing and assembly steps can vary depending upon the application.

Having described the preferred embodiment, it will become apparent that various modifications can be made without departing from the scope of the invention as defined in the accompanying claims.

The invention claimed is:

1. An electronic module, comprising:

a housing including at least two housing parts;

a cable including a sheath end and a plurality of conductors extending from said sheath end; and a one-piece, multi-function seal between said cable and said housing, said multi-function seal including a cable seal overmolded on said cable at said sheath end with said plurality of conductors being exposed from said multi-function seal, said multi-function seal further including an integral gasket extending from said cable seal and positioned between at least two said housing parts, wherein said multi-function seal includes an alignment head coupled with said cable seal at an interior of said housing, said alignment head configured for aligning said plurality of conductors in a predetermined orientation relative to each other, said plurality of conductors extending from said alignment head.

2. The electronic module of claim 1, wherein said cable seal includes a strain relief overmolded on said cable and extending away from said housing.

3. The electronic module of claim 1, wherein said gasket has a generally H-shaped cross section.

4. The electronic module of claim 1, wherein two adjacent said housing parts each include a cut-out, and said cable seal is received within and seals with said cut-outs.

5. The electronic module of claim 1, wherein said plurality of conductors are configured for transmitting at least one of power and data.

6. The electronic module according to claim 1 wherein the predetermined orientation comprises the conducts fanned out generally orthogonally with respect to the sheath end of the cable.

7. The electronic module of claim 1, including a wire presenter with a plurality of holes, each said conductor being positioned within a corresponding said hole, said alignment head being overmolded over said wire presenter.

8. The electronic module of claim 7, including a circuit board within said housing, said circuit board including a plurality of solder holes, each said conductor being positioned within a respective said solder hole.

9. The electronic module of claim 1, including a circuit board within said housing, and a plurality of locating features extending from said gasket for locating said circuit board within said housing.

10. The electronic module of claim 9, wherein said plurality of locating features press against said circuit board.

11. The electronic module of claim 9, wherein each said locating feature has a generally L-shaped cross section.

12. A work machine, comprising:

a structural member; and an electronic module mounted to said structural member, said electronic module including:

a housing including at least two housing parts;

a cable including a sheath end and a plurality of conductors extending from said sheath end; and a one-piece, multi-function seal between said cable and said housing, said multi-function seal including a cable seal overmolded on said cable at said sheath end with said plurality of conductors being exposed from said multi-function seal, said multi-function seal further including an integral gasket extending from said cable seal and positioned between at least two said housing parts, wherein said multi-function seal includes an alignment head coupled with said cable seal at an interior of said housing, said alignment head configured for aligning said plurality of conductors in a predetermined orientation relative to each other, said plurality of conductors extending from said alignment head.

13. The work machine of claim 12, wherein said cable seal includes a strain relief overmolded on said cable and extending away from said housing.

14. The work machine of claim 12, wherein said gasket has a generally H-shaped cross section.

15. The work machine of claim 12, wherein said plurality of conductors are configured for transmitting at least one of power and data.

16. The work machine of claim 12, wherein two adjacent said housing parts each include a cut-out, and said cable seal is received within and seals with said cut-outs.

17. The work machine of claim 12, wherein said structural member includes at least one of a frame and a body.

18. The work machine according to claim 12 wherein the predetermined orientation comprises the conducts fanned out generally orthogonally with respect to the sheath end of the cable.

19. The work machine of claim 12, including a wire presenter with a plurality of holes, each said conductor being positioned within a corresponding said hole, said alignment head being overmolded over said wire presenter.

20. The work machine of claim 19, including a circuit board within said housing, said circuit board including a plurality of solder holes, each said conductor being positioned within a respective said solder hole.

21. The work machine of claim 12, including a circuit board within said housing, and a plurality of locating features extending from said gasket for locating said circuit board within said housing.

22. The work machine of claim 21, wherein said plurality of locating features press against said circuit board.

23. The work machine of claim 21, wherein each said locating feature has a generally L-shaped cross section.

24. A method of manufacturing an electronic module, comprising the steps of:

overmolding a one-piece, multi-function seal over an end of an electrical cable having a plurality of conductors, said multi-function seal including a cable seal overmolded on said cable end with said plurality of conductors being exposed from said multi-function seal, said multi-function seal further including an integral gasket extending from said cable seal;

positioning said multi-function seal on a first housing part such that said gasket overlies an edge of said first housing part;

positioning a second housing part on said gasket such that said gasket overlies an edge of said second housing part, positioning said conductors through holes in a wire presenter; and overmolding an alignment head over said wire presenter, said alignment head coupled with said cable seal at an interior of said housing.

25. The method of manufacturing an electronic module of claim 24, including the step of positioning said cable seal within cut-outs formed in said first housing part and said second housing part.

26. The method of manufacturing an electronic module of claim 24, including the step of positioning said plurality of conductors within respective solder holes in a circuit board.

27. The method of manufacturing an electronic module of claim 26, including the step of locating said circuit board within said housing locating features extending from said gasket.

* * * * *